US008087405B2

(12) United States Patent
Mitchell

(10) Patent No.: US 8,087,405 B2
(45) Date of Patent: Jan. 3, 2012

(54) BOW-TYPE SOFT PROJECTILE LAUNCHER

(75) Inventor: Jeff Mitchell, Tallahassee, FL (US)

(73) Assignee: Marshmellow Fun Company, LLC

( * ) Notice: Subject to any disclaimer, the term of this patent is extended or adjusted under 35 U.S.C. 154(b) by 761 days.

(21) Appl. No.: 11/895,135

(22) Filed: Aug. 23, 2007

(65) Prior Publication Data

US 2009/0050128 A1 Feb. 26, 2009

(51) Int. Cl.
*F41B 11/14* (2006.01)

(52) U.S. Cl. ..... 124/67; 124/56; 124/63; 124/66

(58) Field of Classification Search ..... 124/60, 124/63–67
See application file for complete search history.

(56) References Cited

U.S. PATENT DOCUMENTS

| | | | | | |
|---|---|---|---|---|---|
| 2,069,821 | A * | 2/1937 | Douglas | 124/67 |
| 2,214,224 | A * | 9/1940 | Douglas | 124/67 |
| 3,790,085 | A * | 2/1974 | Ayer | 239/291 |
| 3,877,611 | A * | 4/1975 | Morrison et al. | 222/78 |
| 4,146,009 | A * | 3/1979 | Adams | 124/88 |
| 4,261,321 | A * | 4/1981 | Nishioka | 124/67 |
| 4,708,341 | A * | 11/1987 | Paraskevakos | 482/120 |
| 4,883,042 | A * | 11/1989 | Wackrow | 124/67 |
| 5,224,464 | A * | 7/1993 | Burnham et al. | 124/67 |
| 5,678,528 | A * | 10/1997 | Hadley | 124/25 |
| 5,711,284 | A * | 1/1998 | Keenan, Jr. | 124/49 |
| 5,850,826 | A * | 12/1998 | Guthrie | 124/62 |
| 6,901,922 | B2 * | 6/2005 | Forti et al. | 124/62 |
| 6,904,901 | B2 * | 6/2005 | Mitchell | 124/65 |
| 6,997,770 | B2 * | 2/2006 | Lapointe | 446/39 |
| 7,578,290 | B2 * | 8/2009 | Mitchell | 124/62 |
| 2003/0094167 | A1 * | 5/2003 | Nibecker, Jr. | 124/64 |
| 2004/0200465 | A1 * | 10/2004 | Forti et al. | 124/62 |
| 2004/0255921 | A1 * | 12/2004 | Mitchell | 124/45 |
| 2006/0042615 | A1 * | 3/2006 | Gregory | 124/62 |
| 2006/0180133 | A1 * | 8/2006 | Mitchell | 124/20.1 |
| 2008/0022990 | A1 * | 1/2008 | Mitchell | 124/65 |

* cited by examiner

*Primary Examiner* — Michael David
(74) *Attorney, Agent, or Firm* — J. Wiley Horton

(57) ABSTRACT

A projectile launcher for launching soft projectiles. The projectile launcher features a pump assembly having a cylinder and piston. The piston includes a pump grip so that a pressure charge is generated when the user moves the piston. The pressure charge is released into a chamber which contains a soft projectile. The chamber includes a radius bend joining a projectile receiving orifice to a projectile discharging orifice. The pressure charge is introduced proximate the apex of the radius bend.

20 Claims, 7 Drawing Sheets

BOW-TYPE SOFT PROJECTILE LAUNCHER

BACKGROUND OF THE INVENTION

1. Field of the Invention

This invention relates to the field of soft projectile launching toys. More specifically the present invention comprises a bow-type soft projectile launcher.

2. Description of the Related Art

Projectile launchers have long been known as novelty items. These launchers typically fire potatoes, vegetable slices, marshmallows, tennis balls, and the like. Some are spring loaded, while others use pistons to compress a charge of air. They typically fire a small projectile which can be used in "mock combat" games without actually injuring the target. These devices have also found application other than as novelty items. Some have been used to fire marking projectiles in the veterinary and timber industries. Others have been used as pill injectors for treating horses and cows. Thus, although such projectile launchers are most often viewed as novelty items, their applications may be much broader.

Particularly, in mock combat situations it is desirable to limit the type of projectiles that may be "fired" from a projectile launcher to reduce the risk of injury. One particular concern in the field of novelty projectile launchers is the use of "improvised projectiles." Users of the launcher often attempt to use the launchers to launch hard projectiles which could cause injury Accordingly, it would be beneficial to provide a projectile launcher which cannot be used to launch dangerous improvised projectiles and otherwise limits the risk of injury associated with the use of the projectile launcher.

BRIEF SUMMARY OF THE INVENTION

The present invention comprises a bow-type projectile launcher for launching soft projectiles. The projectile launcher features a pump assembly having a cylinder and piston. The piston is attached to a bow string so that a pressure charge is generated when the user draws and releases the bow string. The pressure charge is released into a chamber which contains a soft projectile. A removable magazine is provided for containing a plurality of soft projectiles. A magazine receiver is provided for attaching the removable magazine to the projectile launcher.

In the preferred embodiment, the pump cylinder has vents in the wall so that the pump assembly can deliver a more sudden pressure pulse to the soft projectile. The vents allow the piston to achieve greater velocity before compressing air into a pressure charge. The preferred embodiment further includes a muzzle projecting outwardly from the chamber and a muzzle brake with a plurality of brake vents. The brake vents prevent a user from inhaling a soft projectile through the muzzle of the projectile launcher.

REFERENCE NUMERALS IN THE DRAWINGS

| | | | |
|---|---|---|---|
| 10 | projectile launcher | 12 | pump assembly |
| 14 | pump grip | 16 | cylinder |
| 18 | vents | 20 | grip |
| 22 | limb | 24 | limb |
| 26 | barrel | 28 | muzzle brake |
| 30 | brake vents | 32 | magazine receiver |
| 34 | magazine | 36 | piston |
| 38 | grip assembly | 40 | chamber |
| 42 | cap | 44 | projectile receiving orifice |
| 46 | radius bend | 48 | projectile discharging orifice |
| 50 | bow string | 52 | projectiles |
| 54 | chambered projectile | 56 | apex |
| 58 | follow-up projectile | 60 | chamber vents |
| 62 | conical surface | 64 | magazine bore |
| 66 | chamber manifold receiver | 68 | seal tab |

DETAILED DESCRIPTION OF THE INVENTION

Figure 1:
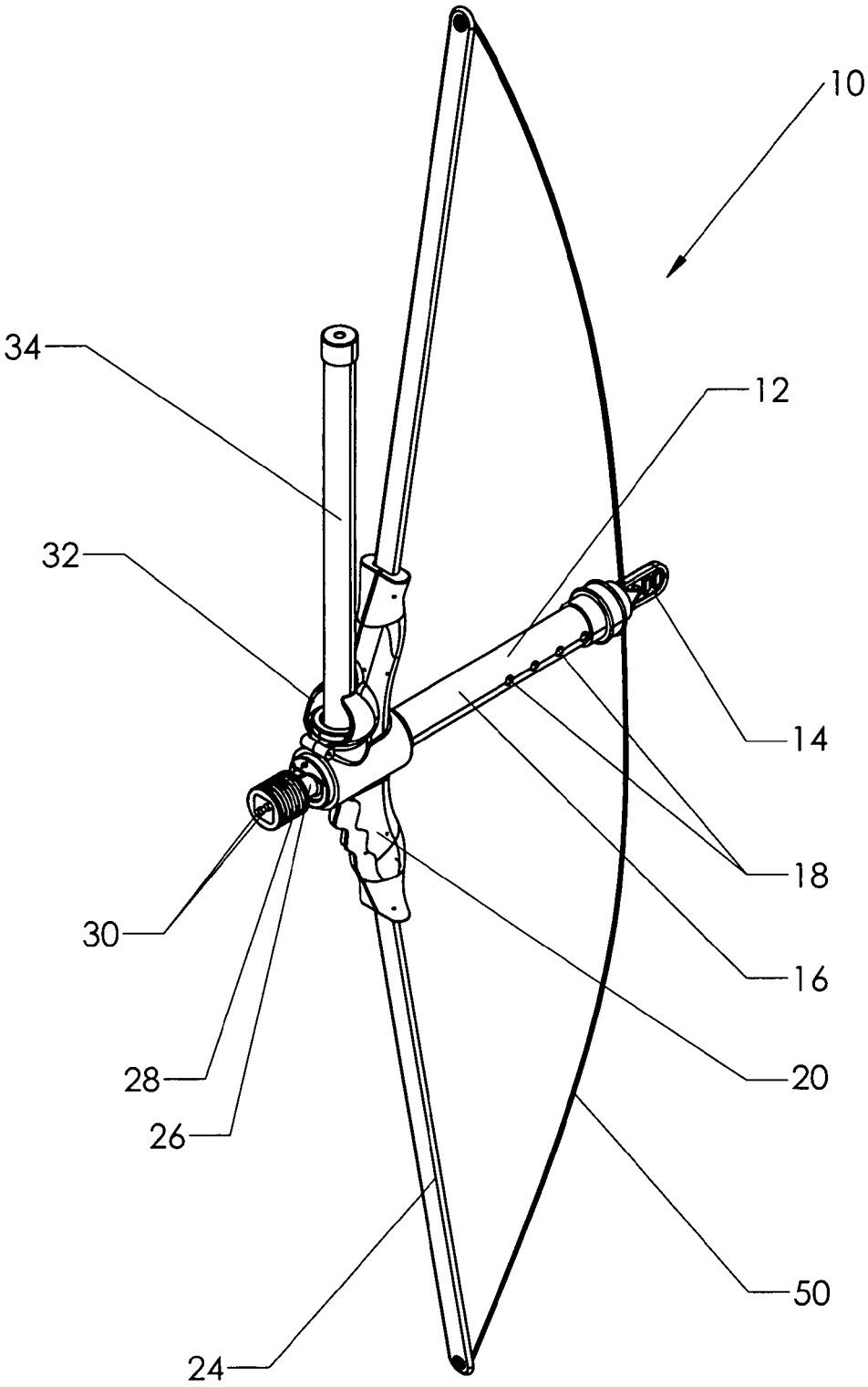
FIG. 1 is a perspective view, showing the present invention

The present invention is shown in its assembled state in FIG. 1. Projectile launcher 10 includes pump assembly 12 which delivers pressure charge into a chamber to launch a soft projectile such as a marshmallow or a deformable foam pellet. The pump assembly includes cylinder 16 which contains a piston. One end of the piston projects out of the hollow interior of the cylinder and terminates at pump grip 14. The pump is generally a positive displacement type pump that generates a pressure charge when the piston is drawn back and then pushed into cylinder 16. Cylinder 16 has vents 18 along its wall. The purpose of vents 18 will be described in greater detail subsequently.

Projectile launcher 10 also includes grip 20 and limbs 22 and 24 which project outward away from grip 20. Bow string 50 attaches to the ends of limb 22 and limb 24. Bow string 50 also attaches to pump grip 14. Bow string 50 transmits the stored energy of limbs 22 and 24 to pump assembly 12 when bow string 50 is drawn and then released.

Vents 18 on cylinder 16 serve a useful purpose which will now be considered in greater detail. When piston 36 is drawn back and then released, air within cylinder 16 provides resistance to the movement of piston 36 back into cylinder 16. As the air is compressed it offers even more resistance. Vents 18 allow compressed air to escape out of cylinder 16 while piston 36 gains velocity traveling through cylinder 16. Thus, vents 18 shorten the length of time the pump takes to accomplish a compression stroke and shorten the length of time over which the pressure charge is discharged into the chamber. This feature allows the pump to create a more "sudden" pressure pulse and launch the projectile further than if no vents were used.

Figure 2A:
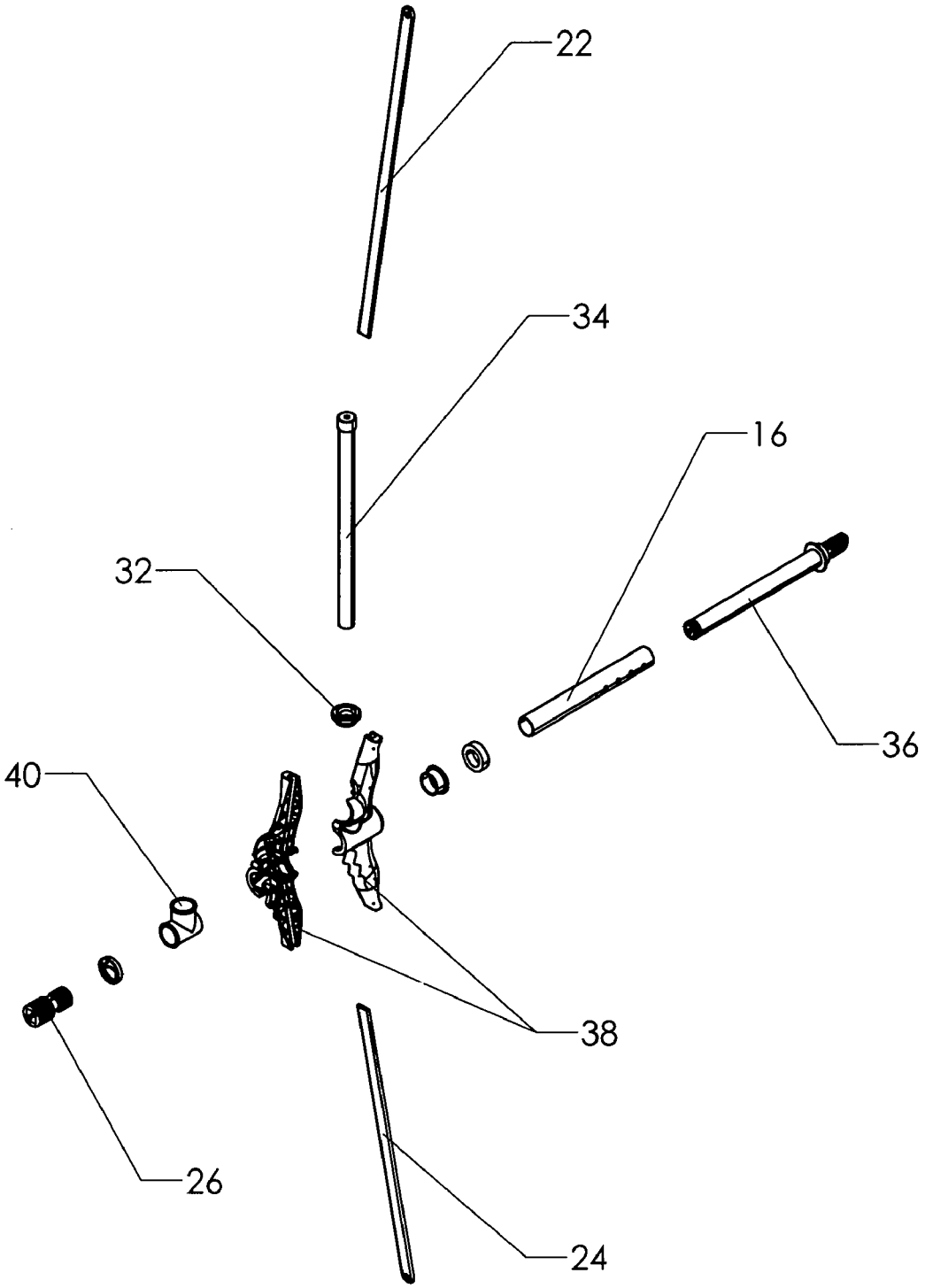
FIG. 2A is an exploded view, showing components of the present invention.
Figure 2B:
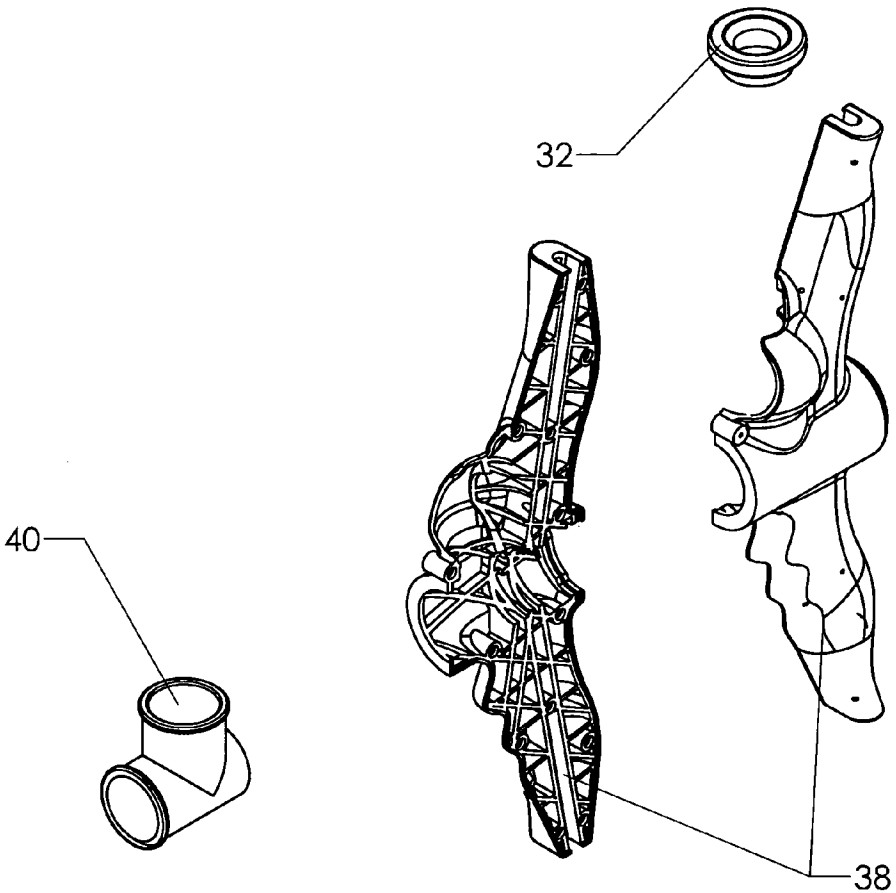
FIG. 2B is an exploded view, showing components of the present invention.

Turning now to FIG. 2, an exploded view of a bow-type projectile launcher is provided. It should be noted that FIG. 2 is merely an illustration of one embodiment of the invention, as the present invention may be fabricated in many different ways. Grip assembly 36 preferably comprises two pieces of molded plastic which attach around chamber 40, barrel 26, magazine receiver 32, cylinder 16, limb 22, and limb 24. As such, grip assembly 38 holds most of the assembly together.

Figure 3:
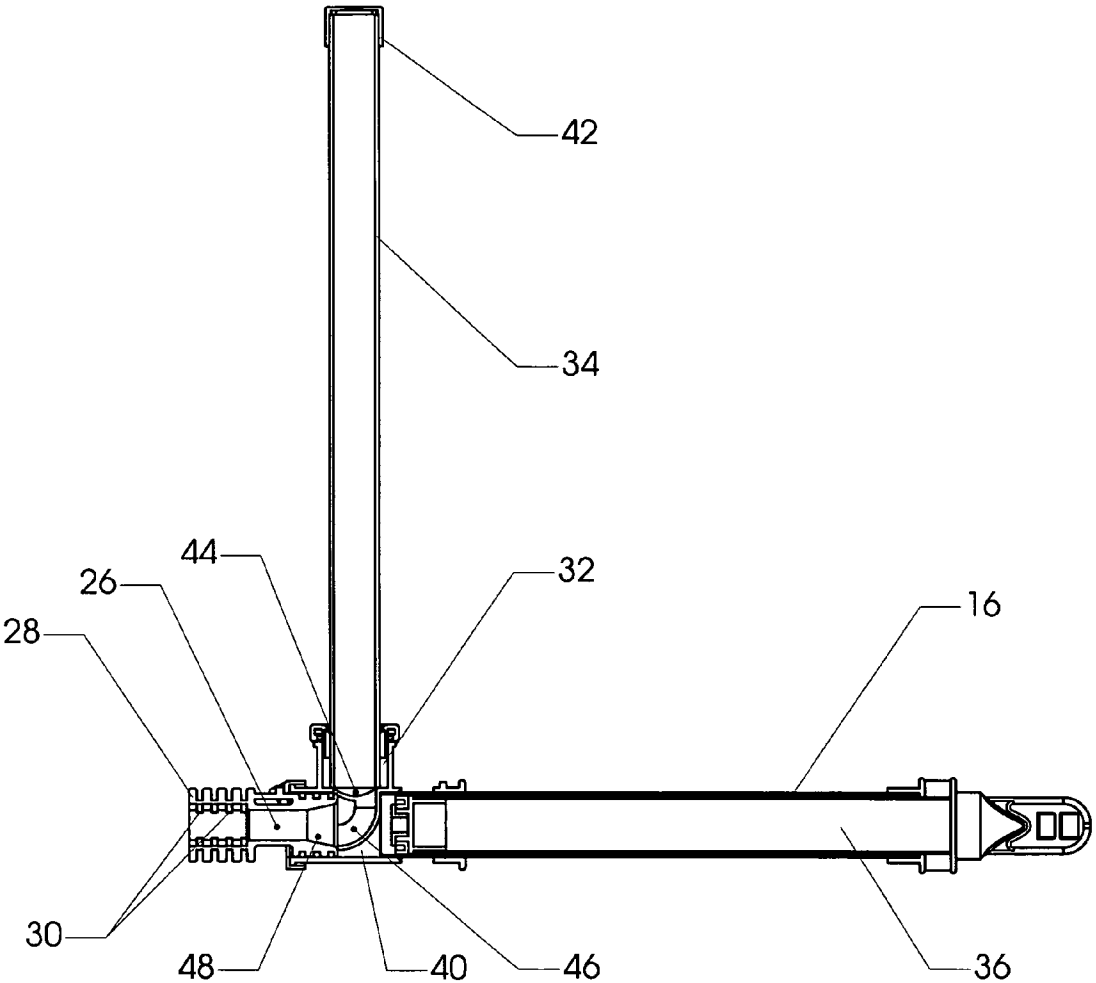
FIG. 3 is a section view, showing the present invention.
Figure 5:
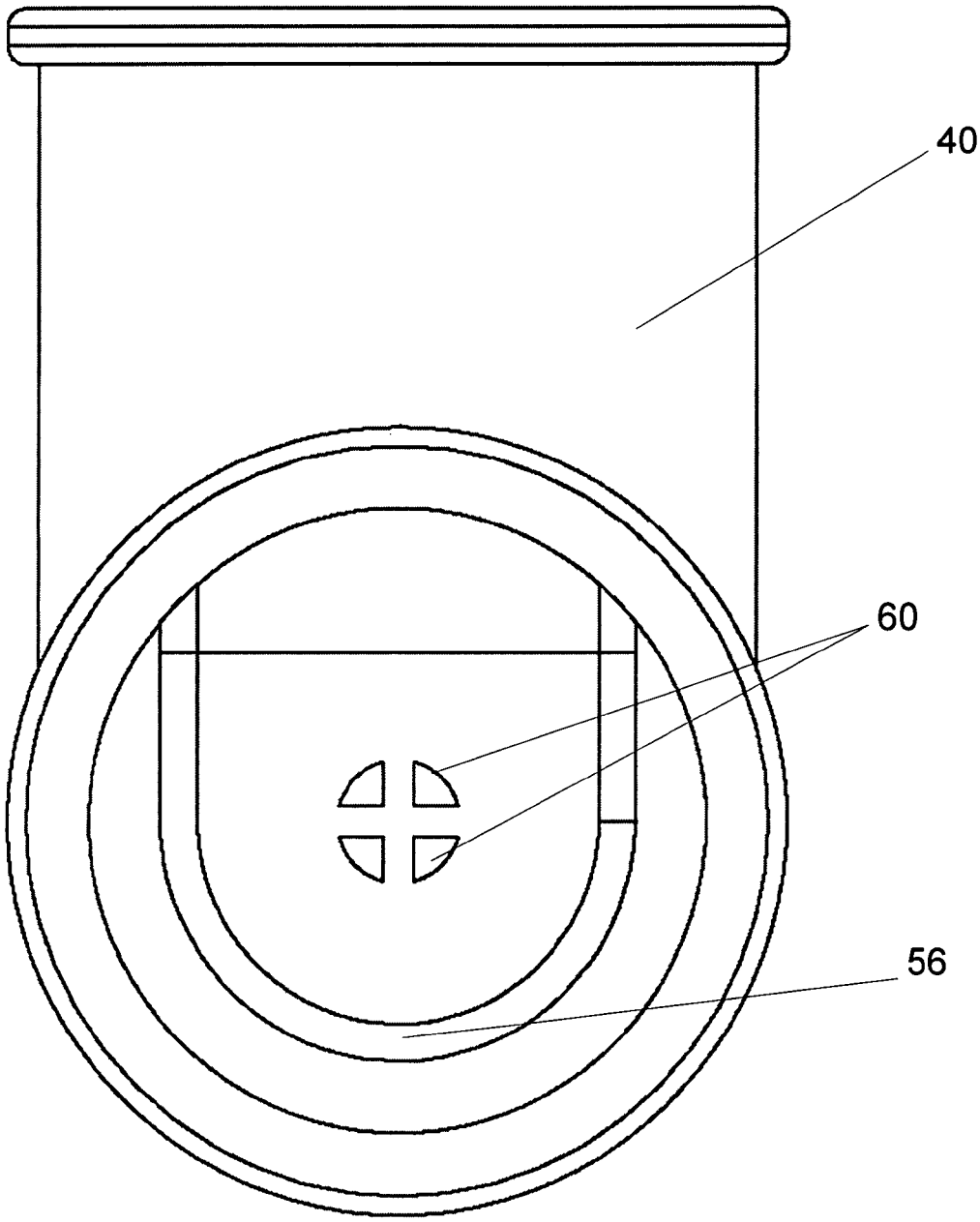
FIG. 5 is a front view, showing a chamber manifold.

FIG. 3 is a section view of several components of the bow-type projectile launcher. Chamber 40 is fluidly connected with the hollow interior of cylinder 16 so that chamber 40 receives the pressure charge generated by the pump. Turning to FIG. 5, the reader will note that chamber 40 has a plurality of chamber vents 60 along its cylinder-facing wall which allow the pressure charge generated by the pump assembly to enter the chamber. Turning back to FIG. 3, chamber 40 has projectile receiving orifice 44 in the top and projectile discharging orifice 48 in the front. A conduit extends between projectile receiving orifice 44 and projectile discharging orifice 48. Radius bend 46, having an approximately 90 degree bend, lies between projectile receiving orifice 44 and projectile discharging orifice 48.

Barrel 26 is fluidly connected with projectile discharging orifice 48 extends away from chamber 40. Muzzle brake 28 is attached to barrel 26. Muzzle brake 28 has brake vents 30. Vents 30 are formed by flanges that extend outwardly away from the bore of barrel 26. Slots are provided between the flanges in the wall of barrel 26 to let air pass from the bore of barrel 26, through the slots in barrel 26, and then between the flanges of muzzle brake 28. Muzzle brake 28 is a safety feature of the present invention. This feature prevents the user from placing their mouth around the muzzle of the projectile launcher and inhaling the soft projectile or discharging a pressure charge into the user's lungs. Brake vents 30 prevent the user from creating suction on the muzzle. If the user inhales through the end of muzzle brake 62, air will simply filter through brake vents 30. If the user puts the muzzle in a person's mouth, the pressure charge will be diverted through brake vents 30 and will not be forced into the person's lungs.

Figure 6:
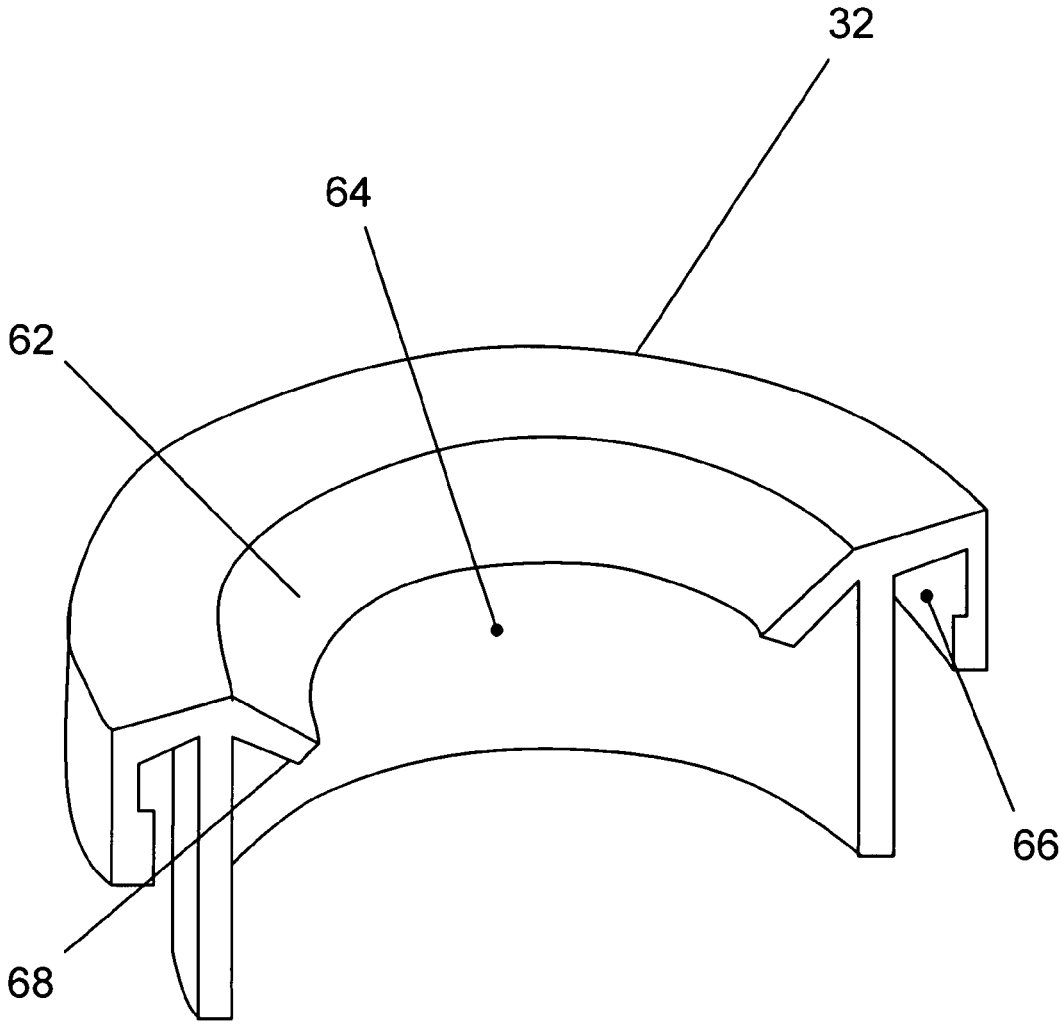
FIG. 6 is a section view, showing a magazine receiver.

Magazine receiver 32 is positioned adjacent to projectile receiving orifice 44. Magazine receiver 32 is configured to receive the open end of removable magazine 34. Turning to FIG. 6, the reader will note that magazine receiver 32 includes chamber manifold receiver 66 which receives the top of chamber 40 and forms an air-tight seal between magazine receiver 32 and chamber 40. Magazine bore 64 passes through the center of magazine receiver 32. Seal tab 68 having conical surface 62 extends into magazine bore 64. Seal tab 68 allows for an air-tight seal to be formed between the outside of magazine 34 and the inside of magazine receiver 32. Magazine receiver 32 is preferably made of a flexible material. When the pump delivers a pressure charge into the chamber, the pressure compresses the flexible portion of magazine receiver 32 (seal tab 68 in the present example) between the magazine and magazine receiver 32 so as to form an air tight seal. As air pressure increases, the seal becomes tighter, thus preventing magazine 34 from unintentionally launching out of the receiver when pressurized. This feature also prevents the pressure charge from escaping between magazine 34 and magazine receiver 32 during launching.

The reader will also notice that magazine receiver 32 allows for the detachment and quick removal of said magazine during reloading. To remove magazine 34, the user simply grasps magazine 34 and pulls it out of magazine receiver 32. The other end of magazine 34 is closed with cap 42. Cap 42 includes a one-way valve. The one-way valve allows the vacuum caused by drawing back piston 36 to pull a projectile from magazine 34 into chamber 40, but would prevent the pressure charge from being expelled through cap 42 when launching the projectile. Thus, although the pump pressurizes the magazine vessel, the one-way valve in the cap forces the pressure charge to exit out the barrel of the projectile launcher behind the projectile.

Figure 4:
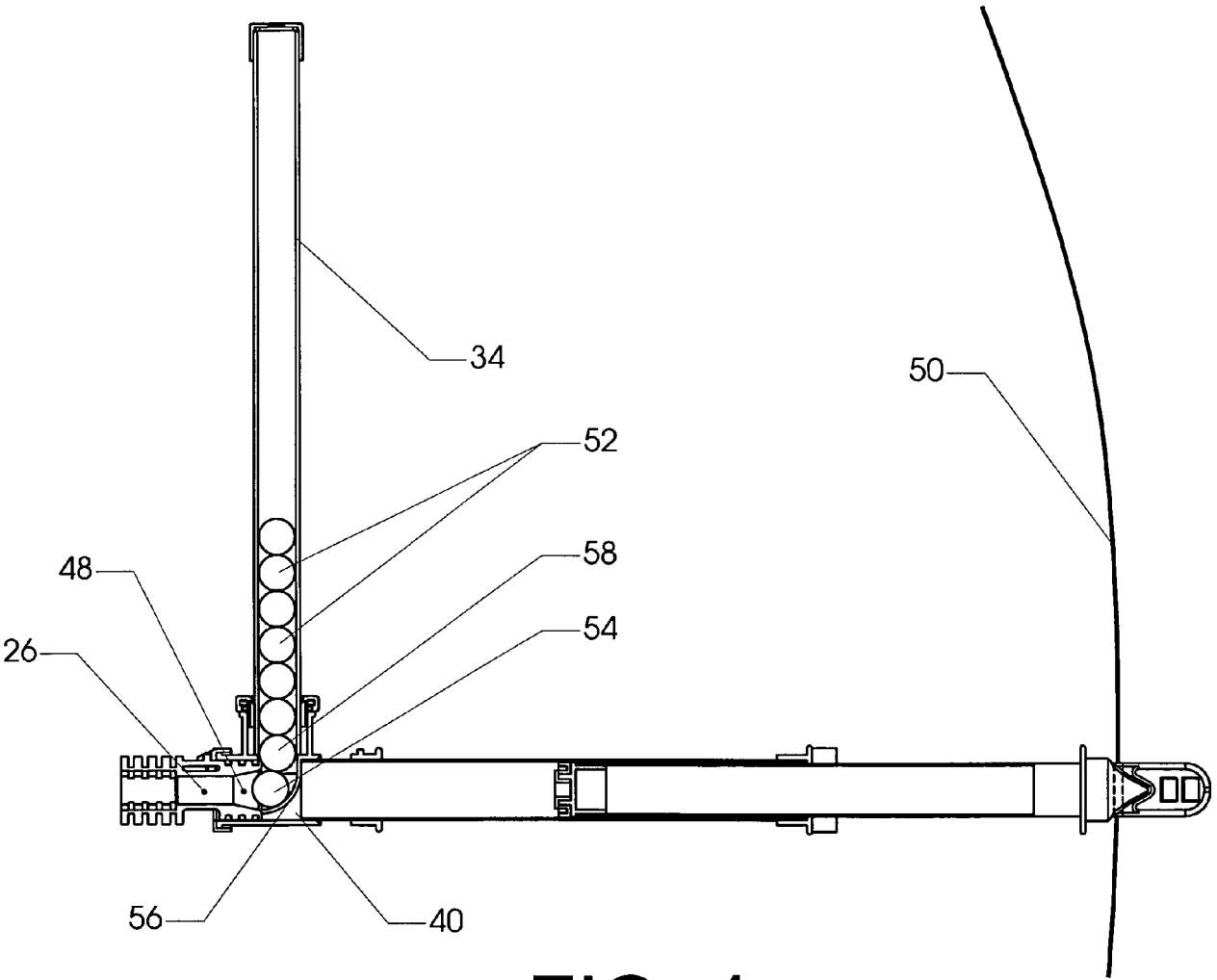
FIG. 4 is a section view, showing the present invention.

Turning to FIG. 4, a magazine configured to contain a plurality of soft projectiles 52 in its hollow interior is shown. The reader will note that chambered projectile 54 comes to rest on apex 56 inside chamber 40. When positioned in the chamber, chambered projectile 54 keeps follow-up projectile 58 inside magazine 34 so that follow-up projectile 58 does not interfere with the launching of chambered projectile 54. Thus, the chamber geometry ensures that removable magazine 34 feeds only follow-up projectile 58 from the hollow interior of removable magazine 34 into chamber 40 after chambered projectile 54 is launched. The reader will also note that projectile discharging orifice 48 has a smaller diameter than soft projectiles 52. This feature causes soft projectiles 52 to compress when entering barrel 26 and prevents the pressure charge from escaping around the soft projectile when the pressure charge is released into the chamber. This tapering of the inner diameter is also a safety measure which prevents "improvised" hard projectiles from forming a tight seal.

With the components of projectile launcher 10 now described, the user will appreciate how the launcher is used. The user first loads magazine 34 with soft projectiles 52. The open end of magazine 34 is inserted into magazine receiver 32. When held upright, chambered projectile 54 comes to rest on apex 56 in chamber 40 (the same result may be accomplished by the vacuum generated by the draw-back of string 50 and piston 36 even if the projectile launcher is not held upright as shown in FIG. 1). The user draws back string 50 and piston 36 and then releases. The release of these components causes a pressure charge to be generated by pump assembly 12. Vents 18 in cylinder 16 allow the piston to gain momentum before the pressure charge is released into chamber 40. This pressure charge passes into chamber 40 and expels chambered projectile through barrel 26 and out of the launcher. The follow-up projectile then falls into place in chamber 40 and the process is repeated.

The preceding description contains significant detail regarding the novel aspects of the present invention. It should not be construed, however, as limiting the scope of the invention but rather as providing illustrations of the preferred embodiments of the invention. As an example, many different bow-type launchers could be designed incorporating the elements of the present invention. Such variations would not alter the function of the invention. Thus, the scope of the invention should be fixed by the following claims, rather than by the examples given.

The invention claimed is:

1. A projectile launcher allowing a user to launch a soft projectile having an external diameter, comprising:

a. a radius bend having an entrance, an exit, and an enclosed interior passing there between, said radius bend having an approximately 90 degree bend;

b. a projectile receiving orifice proximate said entrance;

c. a projectile discharging orifice located proximate said exit of said radius bend, wherein said projectile discharging orifice includes a taper and a smallest portion, with said smallest portion being smaller than said external diameter of said soft projectile, so that said soft projectile must compress in order to pass through said projectile discharging orifice;

d. at least one vent passing through said radius bend; and e. a pump assembly fluidly connected to said at least one vent, said pump assembly including a piston having a pump grip configured to allow said user to grip and move said piston, said pump assembly being configured to blow compressed air through said at least one vent.

2. A projectile launcher as recited in claim 1, further comprising a detachable magazine configured to hold a plurality of said soft projectiles.

3. A projectile launcher as recited in claim 2, further comprising a magazine receiver proximate said projectile receiving orifice, with said magazine receiver being configured to receive said detachable magazine and form a substantially airtight seal between said projectile receiving orifice and said detachable magazine.

4. A projectile launcher as recited in claim 1, further comprising:

a. a first bow limb connected to said radius bend;

b. a second bow limb connected to said radius bend, with said second bow limb extending outward in a direction that is opposite to a direction in which said first bow limb extends; and c. a bow string connecting said first bow limb to said second bow limb, said bow string being additionally connected to said pump grip.

5. A projectile launcher as recited in claim 4, wherein said first bow limb includes a grip proximate said radius bend.

6. A projectile launcher as recited in claim 1, wherein:

a. said pump assembly includes a cylindrical housing defining a hollow interior which slidably mounts said piston, said cylindrical housing having a first end proximate said radius bend and a second end distal to said radius bend; and b. wherein said cylindrical housing includes at least one lateral vent fluidly connecting said hollow interior to ambient air, said at least one lateral vent being located proximate said second end of said cylindrical housing.

7. A projectile launcher allowing a user to launch a soft projectile having an external diameter, comprising:

a. a pump assembly having a first end and a second end, including, i. a piston slidably mounted within said pump assembly, ii. said piston including a pump grip configured to allow said user to grip and move said piston, iii. said pump assembly configured to discharge air compressed by said piston out said first end of said pump assembly;

b. a radius bend having an enclosed interior with an entrance and an exit an enclosed interior passing therebetween, said radius bend having an approximately 90 degree bend;

c. said entrance comprising a projectile receiving orifice for receiving one of said soft projectiles;

d. a projectile discharging orifice located proximate said exit of said radius bend, wherein said projectile discharging orifice includes a taper and a smallest portion, with said smallest portion being is smaller than said external diameter of said soft projectile, so that said soft projectile must compress in order to pass through said projectile discharging orifice; and e. at least one vent passing through said radius bend, and connecting said enclosed interior to said second end of said pump assembly.

8. A projectile launcher as recited in claim 7, further comprising a detachable magazine configured to hold a plurality of said soft projectiles.

9. A projectile launcher as recited in claim 8, further comprising a magazine receiver proximate said projectile receiving orifice, with said magazine receiver being configured to receive said detachable magazine and form a substantially airtight seal between said projectile receiving orifice and said detachable magazine.

10. A projectile launcher as recited in claim 7, further comprising:

a. a first bow limb connected to said radius bend;

b. a second bow limb connected to said radius bend, with said second bow limb extending outward in a direction that is opposite to a direction in which said first bow limb extends; and c. a how string connecting said first bow limb to said second bow limb, said bow string being additionally connected to said pump grip.

11. A projectile launcher as recited in claim 10, wherein said first bow limb includes a grip proximate said radius bend.

12. A projectile launcher as recited in claim 7, wherein:

a. said pump assembly includes a cylindrical housing defining a hollow interior which slidably mounts said piston, said cylindrical housing having a first end proximate said radius bend and a second end distal to said radius bend; and b. wherein said cylindrical housing includes at least one lateral vent fluidly connecting said hollow interior to ambient air, said at least one lateral vent being located proximate said second end of said cylindrical housing.

13. A projectile launcher allowing a user to launch a soft projectile having an external diameter, comprising:

a. a pump assembly, including, i. a cylinder, having a first end and a second end, ii. a piston slidably mounted within said cylinder, iii. said piston including a pump grip configured to allow said user to grip and move said piston, iv. said cylinder and piston configured to discharge air compressed by said piston out said first end of said cylinder;

b. a chamber fluidly connected to said first end of said cylinder;

c. said chamber including a projectile receiving orifice for receiving one of said soft projectiles;

d. said chamber including a projectile discharging orifice, wherein said projectile discharging orifice includes a taper and a smallest portion, with said smallest portion being smaller than said external diameter of said soft projectile, so that said soft projectile must compress in order to pass through said projectile discharging orifice;

e. said chamber including a radius bend having an enclosed interior, with said enclosed interior connecting said projectile receiving orifice to said projectile discharging orifice, said radius bend having an approximately 90 degree bend; and f. at least one vent passing through said radius bend, and connecting said enclosed interior to said first end of said cylinder.

14. A projectile launcher as recited in claim 13, further comprising a detachable magazine configured to hold a plurality of said soft projectiles.

15. A projectile launcher as recited in claim 14, further comprising a magazine receiver proximate said projectile receiving orifice, with said magazine receiver being configured to receive said detachable magazine and form a substantially airtight seal between said projectile receiving orifice and said detachable magazine.

16. A projectile launcher as recited in claim 13, further comprising:

a. a first bow limb connected to said chamber;

b. a second bow limb connected to said chamber, with said second bow limb extending outward in a direction that is opposite to a direction in which said first bow limb extends; and c. a bow string connecting said first bow limb to said second bow limb, said bow string being additionally connected to said pump grip.

17. A projectile launcher as recited in claim 16, wherein said first bow limb includes a grip proximate said radius bend.

18. A projectile launcher as recited in claim 16, further comprising a detachable magazine configured to hold a plurality of said soft projectiles.

19. A projectile launcher as recited in claim 13, wherein said cylinder includes at least one lateral vent fluidly connecting an interior of said cylinder to ambient air, said at least one lateral vent being located proximate said second end of said cylinder.

20. A projectile launcher as recited in claim 19, further comprising a detachable magazine configured to hold a plurality of said soft projectiles.

* * * * *